US010646981B2

(12) United States Patent
Kennedy et al.

(10) Patent No.: US 10,646,981 B2
(45) Date of Patent: May 12, 2020

(54) SCREWDRIVER WITH SCREW RETENTION MECHANISM

(71) Applicant: Titan Spine, LLC, Mequon, WI (US)

(72) Inventors: Eric Kennedy, Wauwatosa, WI (US); Charles J. Turner, Milwaukee, WI (US)

(73) Assignee: Titan Spine, Inc., Mequon, WI (US)

( * ) Notice: Subject to any disclaimer, the term of this patent is extended or adjusted under 35 U.S.C. 154(b) by 346 days.

(21) Appl. No.: 15/136,171

(22) Filed: Apr. 22, 2016

(65) Prior Publication Data

US 2017/0305000 A1 Oct. 26, 2017

(51) Int. Cl.
*B25B 23/10* (2006.01)

(52) U.S. Cl.
CPC ..... *B25B 23/108* (2013.01); *B25B 23/106* (2013.01)

(58) Field of Classification Search
CPC ..... B25B 23/106; B25B 15/008; B25B 13/54; B25B 23/108; B25B 15/005; B25B 23/10
See application file for complete search history.

(56) References Cited

U.S. PATENT DOCUMENTS

| | | | | |
|---|---|---|---|---|
| 3,286,749 | A * | 11/1966 | Learned | B25B 15/005 81/448 |
| 4,007,768 | A * | 2/1977 | Matsushima | B25B 15/008 81/448 |
| 4,060,114 | A | 11/1977 | Matsushima | |
| 6,681,662 | B2 | 1/2004 | Blackston | |
| 7,137,322 | B2 * | 11/2006 | Mark | A61B 17/888 81/452 |
| 7,174,615 | B2 | 2/2007 | Mark et al. | |
| 7,249,544 | B2 * | 7/2007 | Totsu | B25B 15/005 81/448 |
| 8,172,854 | B2 | 5/2012 | Blain et al. | |
| 8,347,768 | B2 | 1/2013 | Witte | |
| 8,770,068 | B2 | 7/2014 | Witte | |
| 2008/0275459 | A1 | 11/2008 | Dickinson et al. | |
| 2010/0121385 | A1 | 5/2010 | Blain et al. | |
| 2011/0098715 | A1 * | 4/2011 | Laubert | A61B 17/861 606/104 |
| 2012/0232664 | A1 | 9/2012 | Ullrich et al. | |

* cited by examiner

*Primary Examiner* — Robert J Scruggs

(57) ABSTRACT

A screwdriver for resisting premature disengagement of a screw from the screwdriver. The screwdriver includes a shaft having a central axis; a tip radially aligned with the central axis of the shaft which includes an end opposite the shaft, at least one radial protrusion extending away from the central axis, and a notch; and a screw retention mechanism including a flexible member aligned with the notch and attached to either the tip or the shaft. The flexible member has an unattached end which is separated from the second end of the tip. When the tip is inserted into a recess of a screw, the flexible member flexes toward the central axis and creates an opposing elastic force which holds the screw to the tip.

20 Claims, 10 Drawing Sheets

SCREWDRIVER WITH SCREW RETENTION MECHANISM

FIELD OF THE INVENTION

The invention relates generally to a screwdriver. More particularly, the invention relates to a screwdriver having a retention mechanism which prevents a screw from prematurely disengaging from the screwdriver.

BACKGROUND OF THE INVENTION

Various publications, including patents, published applications, technical articles and scholarly articles are cited throughout the specification. Each of these cited publications is incorporated by reference herein, in its entirety and for all purposes.

A screwdriver is a tool for turning screws and typically includes a handle, a shaft, and a shaped tip that a user inserts into the screw to turn it. Screwdrivers are classified according to the size and shape of their tips, which correspond to driving surfaces (e.g., slots, grooves, recesses, etc.) on the screw head. The tip can have a wide range of known shapes and sizes, including for example flat, phillips, hexagonal, star-shaped, pentalobe, and hexalobe.

One common problem with screwdrivers is a tendency for the screw to prematurely disengage from the screwdriver before the screw is secured in the desired substrate. This is particularly an issue when the screw is being installed in tight spaces or at extreme angles. In such conditions, the user may be unable to stabilize the screw while it is turned. Surgical procedures are an example of a situation in which screws are used and tight spaces or extreme angles are encountered. A screw becoming disengaged from the screwdriver prematurely during surgery potentially causes frustration, an inability to insert the screw, or even injury to the patient in rare cases. Other possible situations where premature disengagement is problematic include automotive, aerospace, underwater, and high wind environments.

Accordingly, a screwdriver which includes a retention mechanism that is able to prevent premature disengagement of a screw from the screwdriver is desirable.

SUMMARY OF THE INVENTION

The invention features a screwdriver which reduces the likelihood of premature disengagement of a screw from the screwdriver.

In one embodiment, the screwdriver includes a shaft having a central axis; a tip radially aligned with the central axis of the shaft having an end opposite the shaft, at least one radial protrusion extending away from the central axis, and a notch; and a screw retention mechanism including a flexible member aligned with the notch and attached to either the tip or the shaft. The flexible member has an unattached end which is separated from the second end of the tip. When the tip is inserted into a recess of a screw, the flexible member bends toward the central axis and creates an opposing elastic force which holds the screw to the tip. The tip may be integral with the shaft, or may be detachable from the shaft. The tip may have six lobe-shaped protrusions. The flexible member may be a separate element from the tip and the shaft, or may be integral with the tip and the shaft. The notch may be in the radial protrusion, or may be in a valley adjacent to the at least one radial protrusion. The valley is defined by a radial height less than the radial height of the at least one radial protrusion.

In another embodiment, the screwdriver includes a shaft having a shaft having a central axis; a tip radially aligned with the central axis of the shaft having an end opposite the shaft, at least one regular protrusion, and at least one notched protrusion; and a flexible member aligned with the notched protrusion and attached to either the tip or the shaft. The flexible member has an unattached end which is separated from the end of the tip and a raised section adjacent to the unattached end. When the flexible member is in an unstressed position, a leading edge of the unattached end has a radial height less than a radial height of the at least one regular protrusion and the raised section has a radial height greater than the radial height of the at least one regular protrusion. When the tip is inserted into a recess of a screw, the flexible member bends toward the central axis and creates an opposing elastic force which holds the screw to the tip. The tip may be integral with the shaft, or may be detachable from the shaft. The tip may have six lobe-shaped protrusions, one of which is the notched protrusion. The flexible member may be a separate element from the tip and the shaft, or may be integral with the tip and the shaft.

In another embodiment, the screwdriver includes a shaft having a central axis; a tip radially aligned with the central axis of the shaft having an end opposite the shaft, at least one radial protrusion, a regular valley on a first side of the at least one radial protrusion, and a notched valley on a second side of the at least one radial protrusion opposite the first side; and a flexible member aligned with the notched valley and attached to either the tip or the shaft. The flexible member has an unattached end which is separated from the end of the tip and a raised section adjacent to the unattached end. When the flexible member is in an unstressed position, the unattached end has a radial height less than a radial height of the regular valley and the raised section has a radial height greater than the radial height of the regular valley. When the tip is inserted into a recess of a screw, the flexible member bends toward the central axis and creates an opposing elastic force which holds the screw to the tip. The tip may be integral with the shaft, or may be detachable from the shaft. The tip may have six lobe-shaped protrusions. The flexible member may be a separate element from the tip and the shaft, or may be integral with the tip and the shaft.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

When referring to the drawing, like reference numbers refer to like elements throughout the various figures that comprise the drawing.

DETAILED DESCRIPTION OF THE INVENTION

Figure 1A:
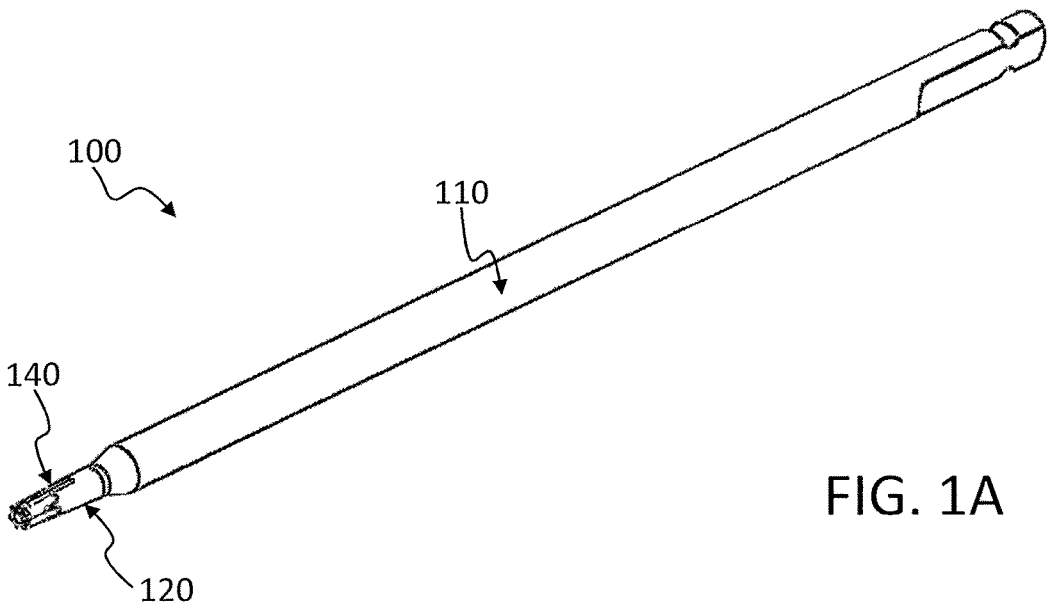
FIG. 1A shows a perspective view of an embodiment of a screwdriver.
Figure 1B:
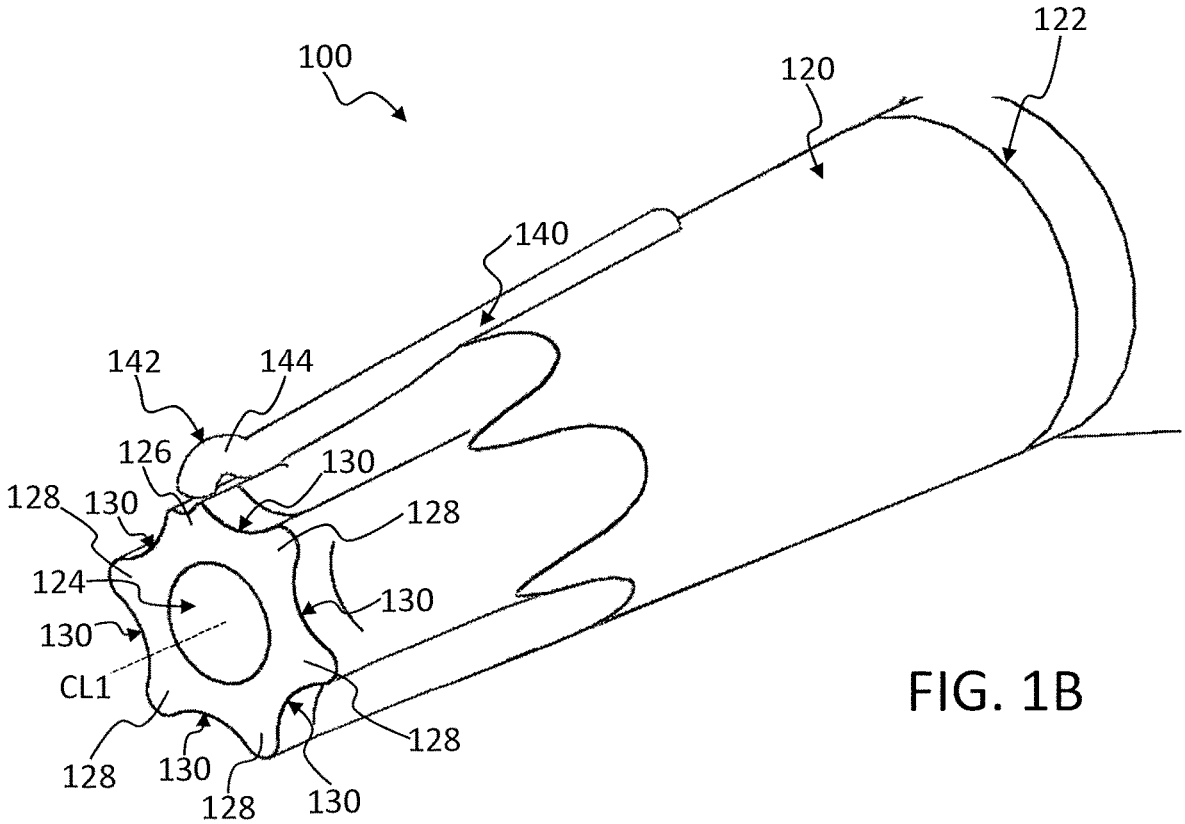
FIG. 1B shows a close-up view of the screwdriver tip.
Figure 1C:
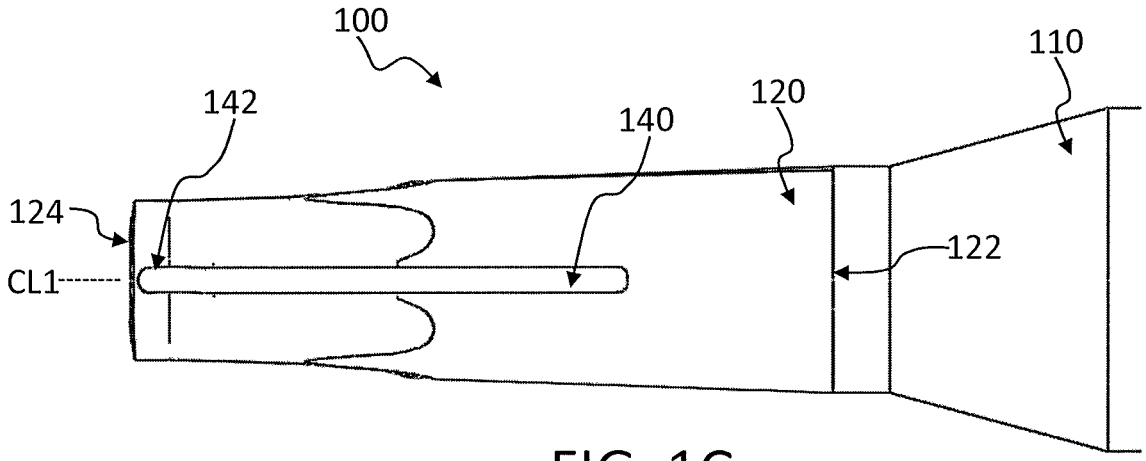
FIG. 1C shows a top view of the screwdriver tip.
Figure 1D:
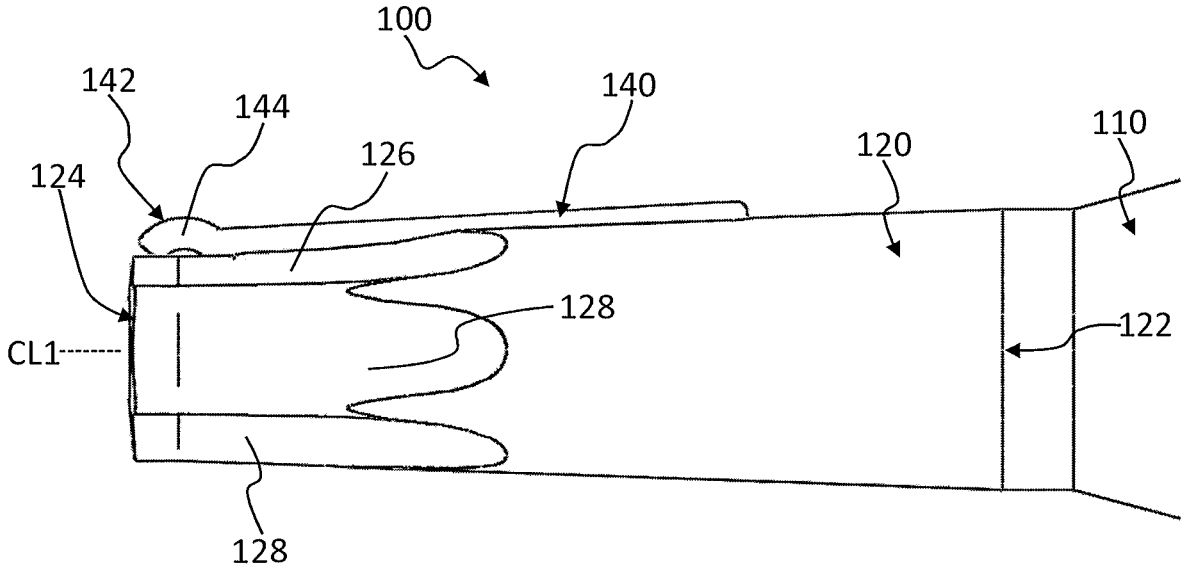
FIG. 1D shows a side view of the screwdriver tip.

Various terms are used throughout the specification and claims. Such terms are to be given their ordinary meaning in the art, unless otherwise indicated. Other specifically defined terms are to be construed in a manner consistent with the definition provided herein.

As used herein, the singular forms "a," "an," and "the" include plural referents unless expressly stated otherwise.

The invention provides screwdrivers that include screw retention mechanisms to prevent premature disengagement of a screw from a tip of the screwdriver. The screwdrivers include a shaft having a central axis, a tip, and a flexible member attached either to the tip or the shaft. When the tip of the screwdriver is inserted into a recess of a screw, the flexible member flexes toward the central axis and fits inside the recess. The elastic force supplied by the flexed elastic member provides for a tension fit which holds the screw to the screwdriver. Once the screw is secured in the desired substrate, the user may remove the screwdriver tip from the screw simply by pulling on the screwdriver parallel to the length of the shaft. Because screwdrivers are designed to fit standard screw shapes and sizes, they further have the advantage of not requiring special fasteners that would increase cost and complexity of use.

Referring to FIGS. 1A-1D, a screwdriver 100 having a screw retention mechanism is provided according to a first embodiment. The screwdriver 100 includes a shaft 110 and a tip 120. The tip 120 is aligned with a central axis CL1 of the shaft 110. A first end 122 of the tip 120 is attached to the shaft 110 and a second end 124 is opposite the first end 122. The shaft 110 and the tip 120 may be integral (e.g., formed from a single piece), permanenty attached (e.g., formed from separate pieces but attached in a way that does not allow separation), or removably attached (for example, to allow multiple tips to be attached to a single shaft).

The tip 120 is shaped to fit a slot or recess in a corresponding screw. For example, the tip 120 may be shaped to fit a corresponding screw having any standard recess shape, including, but not limited to, flat, cross, phillips, pentalobular, hexalobular, etc. The tip 120 includes at least one radial protrusion which extends away from the central axis CL1. In the embodiment depicted in FIGS. 1A-1D, the tip 120 includes one truncated protrusion 126 and five regular protrusions 128 in a hexalobular shape. The truncated protrusion 126 is notched and therefore is radially shorter than the regular protrusions 128 when measured from the central axis CL1 at the notch. The protrusions 126, 128 are separated by valleys 130, which are radially shorter than the adjacent regular protrusions 128. Typically (but not necessarily), the protrusions 126, 128 and valleys 130 are arranged in a regular pattern around the central axis CL1. Although the tip 120 depicted in FIGS. 1A-1D has a concave shape, the tip 120 may also be convex. For example, the tip 120 may have a cross section in the shape of a regular polygon, such as a hexagon. In such an embodiment, the regular protrusions 128 are defined by the vertices of the polygon, and the valleys 130 are defined by the sides of the polygon. One of the vertices of the polygon is notched and therefore defines the truncated protrusion 126.

The screw retention mechanism of the screwdriver 100 includes an elastic member 140 which is aligned with the notch of the truncated protrusion 126. The elastic member 140 may be made of any suitable flexible, elastic material, for example metal or rubber. In the embodiment depicted in FIGS. 1A-1D, the elastic member 140 is attached to the shaft 110 and includes an unattached end 142 which is separated from the second end 124 of the tip 120 in an unstressed position. In other embodiments, the elastic member 140 may be attached to the tip 120 near the first end 122. The elastic member 140 may be a separate element which is attached to the tip 120 or the shaft 110, or it may be integral with the shaft 110 or the tip 120. The unattached end 142 includes a raised section 144. In the embodiment depicted in FIGS. 1A-1D, the raised section 144 may be a downward-facing curved portion (e.g., a curved portion which opens toward the central axis CL1). In other embodiments (for example, the screwdriver 200 discussed in more detail below), the raised section 144 may be a protrusion extending away from the central axis CL1. In an unstressed position, the raised section 144 has a height (the distance from the central axis CL1) which is greater than the height of the regular protrusions 128. The height of the elastic member 140 at the leading edge of the unattached end 142, however, is less than the height of the regular protrusions 128 in the unstressed position, allowing the unattached end 142 to be inserted along with the tip 120 into a corresponding screw.

When the tip 120 is inserted into the recess of a corresponding screw, the unattached end 142 will flex, for example, bend down, toward the central axis CL1 to fit the raised section 144 inside the recess, causing the raised section 144 to press against the inside of the recess, creating a tension fit which holds the screw to the tip 120 of the screwdriver 100. The raised section 144 and the truncated protrusion 126 are sized so that the combined height of the raised section 144 and the truncated protrusion 126 (the distance from the central axis CL1) is approximately the same as or less than the heights of the regular protrusions 128 so that the tip 120 and the elastic member 140 are able to fit in the corresponding screw. To further facilitate attaching the screw to the tip 120, the tip 120 may extend beyond the unattached end 142 of the elastic member 140. This gap between the second end 124 of the tip 120 and the unattached end 142 of the elastic member 140 allows the regular protrusions 128 to enter the screw recess first and ensure proper alignment between the tip 120 and the screw. Otherwise, were the tip 120 and the screw recess misaligned, the flexible member 140 may not enter the recess and instead be splayed out (e.g., forced away from, rather than toward, the central axis CL1).

Once the screw is secured in the appropriate location, the screwdriver 100 may be easily disengaged from the screw by simply pulling away from the screw parallel to the central axis CL1. Although the elastic member 140 generates sufficient tension to prevent premature disengagement of the screw from the screwdriver 100, it does not hold the screw so tightly to the tip 120 that normal operation of the screwdriver (i.e., inserting the tip 120 into the screw, turning the screw in the substrate, and removing the tip 120 from the screw) is interfered with.

Figure 2A:
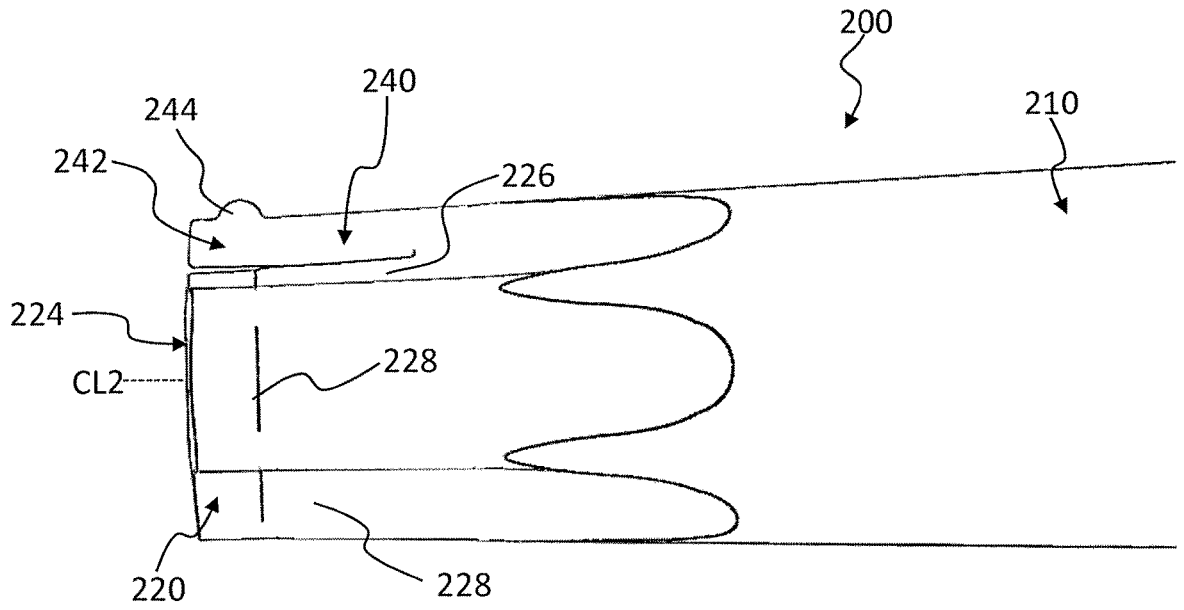
FIG. 2A shows a side view of another embodiment of a screwdriver tip.
Figure 2B:
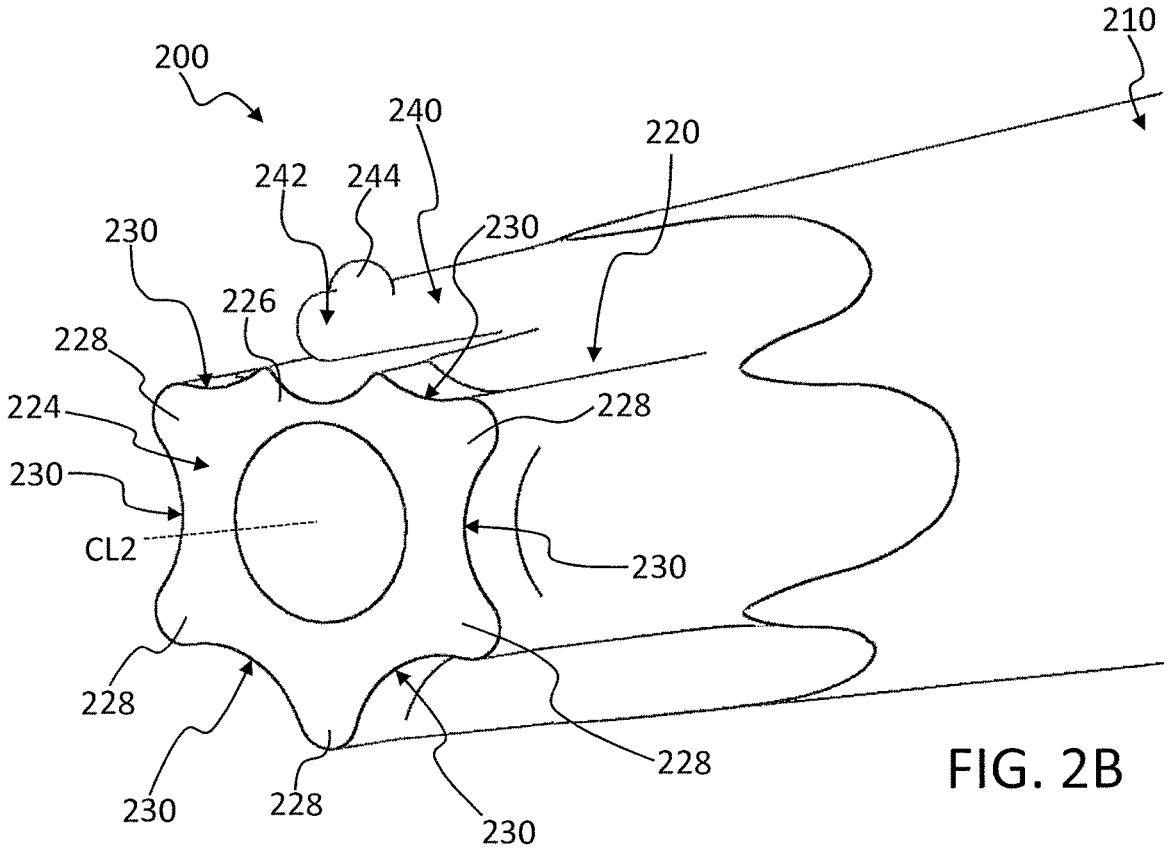
FIG. 2B shows a perspective view of the screwdriver tip.
Figure 2C:
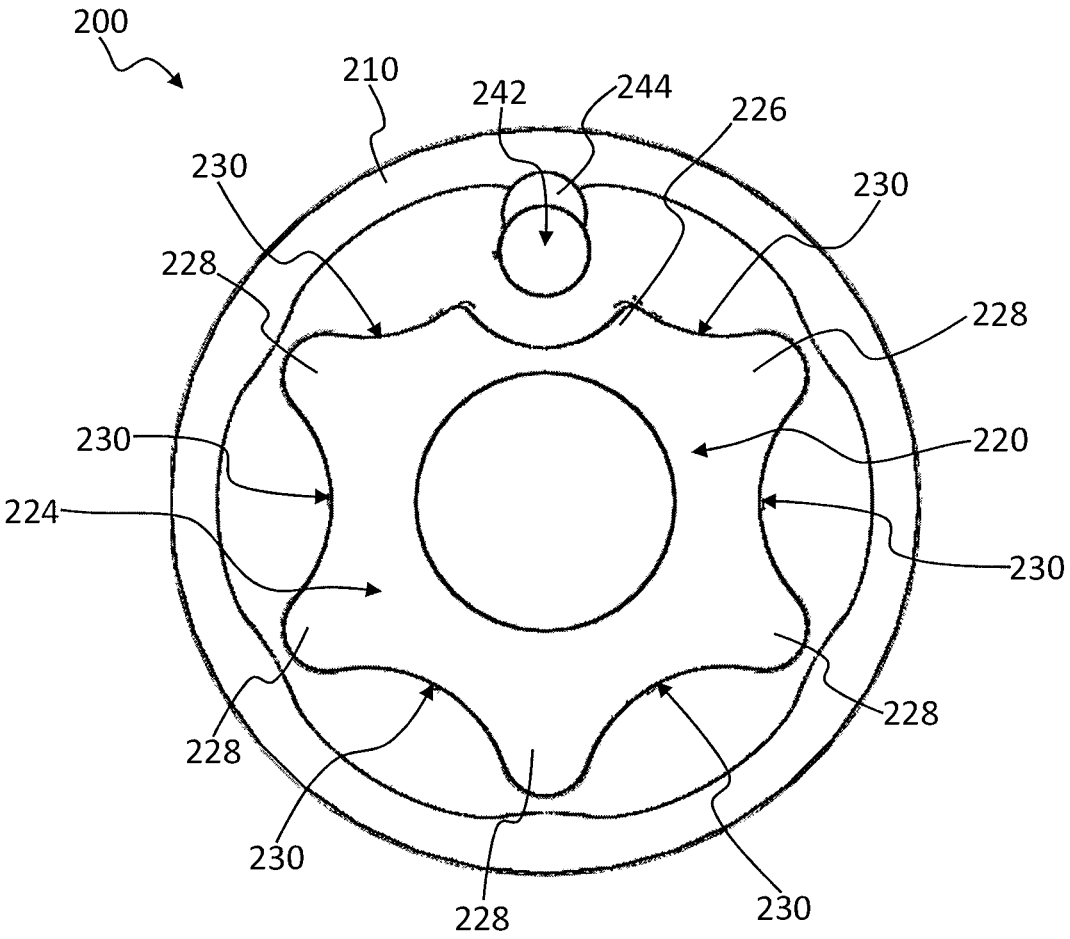
FIG. 2C shows a front view of the screwdriver tip.

Referring to FIGS. 2A-2C, a screwdriver 200 having a screw retention mechanism is provided according to another embodiment of the invention. The screwdriver 200 includes a shaft 210, a tip 220, and an elastic member 240. The shaft 210, the tip 220, and the elastic member 240 are preferably made from a single piece of material. Any suitable material may be used, for example metal, plastic, or rubber, as long as the material provides for sufficient rigidity in the shaft 210 and the tip 220, but also sufficient flexibility in the elastic member 240. A rigid shaft 210 but flexible elastic member 240 is achieved by making the flexible elastic member 240 substantially thinner than the shaft 210. Because the design is made from a single piece of material, it may be additively manufactured (e.g., 3D printed) to reduce manufacturing costs. The shaft 210 and the tip 220 share a common central axis CL2.

The tip 220 is shaped to fit a slot or recess in a corresponding screw. For example, the tip 220 may be shaped to fit a corresponding screw having any standard recess shape, including, but not limited to, flat, cross, phillips, pentalobular, hexalobular, etc. The tip 220 includes at least one radial protrusion which extends away from the central axis CL2. In the embodiment depicted in FIGS. 2A-2C, the tip 220 includes one truncated protrusion 226 and five regular protrusions 228 in a hexalobular shape. The truncated protrusion 226 is notched and therefore is radially shorter than the regular protrusions 228 when measured from the central axis CL2 at the notch. The protrusions 226, 228 are separated by valleys 230, which are radially shorter than the adjacent protrusions. Typically (but not necessarily), the protrusions 226, 228 and valleys 230 are arranged in a regular pattern around the central axis CL2. Although the tip 220 depicted in FIGS. 2A-2C has a concave shape, the tip 220 may also be convex. For example, the tip 220 may have a cross section in the shape of a regular polygon, such as hexagonal. In such an embodiment, the protrusions 226, 228 are defined by the vertices of the polygon, and the valleys 230 are defined by the sides of the polygon. One of the vertices of the polygon is notched and therefore defines the truncated protrusion 226.

The screw retention mechanism of the screwdriver 200 includes the elastic member 240 which is aligned with the notch of the truncated protrusion 226. The elastic member 240 has an unattached end 242 which is separate from an end 224 of the tip 220 in an unstressed position. The unattached end 242 includes a raised section 244. In the embodiments pictured in FIGS. 2A-2C, the raised section 244 is a protrusion extending away from the central axis CL2. In an unstressed position, the raised section 244 has a height (the distance from the central axis CL2) which is greater than the height of the regular protrusions 228. The height of the elastic member 240 at the unattached end 242, however, is less than the height of the regular protrusions 228 in the unstressed position, allowing the unattached end 242 to be inserted along with the tip 220 into a corresponding screw.

When the tip 220 is inserted into the recess of the corresponding screw, the unattached end 242 will flex, for example, bend down toward the central axis CL2 to fit inside the recess, causing the raised section 244 to press against the inside of the recess, creating a tension fit which holds the screw to the tip 220 of the screwdriver 200. The raised section 244 and the truncated protrusion 226 are sized so that the combined height of the raised section 244 and the truncated protrusion 226 (the distance from the central axis CL2) is approximately the same as or less than the heights of the regular protrusions 228 so that the tip 220 and elastic member 240 are able to fit in the corresponding screw.

Once the screw is secured in the appropriate location, the screwdriver 200 may be easily disengaged from the screw by simply pulling away from the screw parallel to the central axis CL2. Although the elastic member 240 generates sufficient tension to prevent premature disengagement of the screw from the screwdriver 200, it does not hold the screw so tightly to the tip 220 that normal operation of the screwdriver (e.g., inserting the tip 220 into the screw, turning the screw in the substrate, and removing the tip 220 from the screw) is interfered with.

Figure 3A:
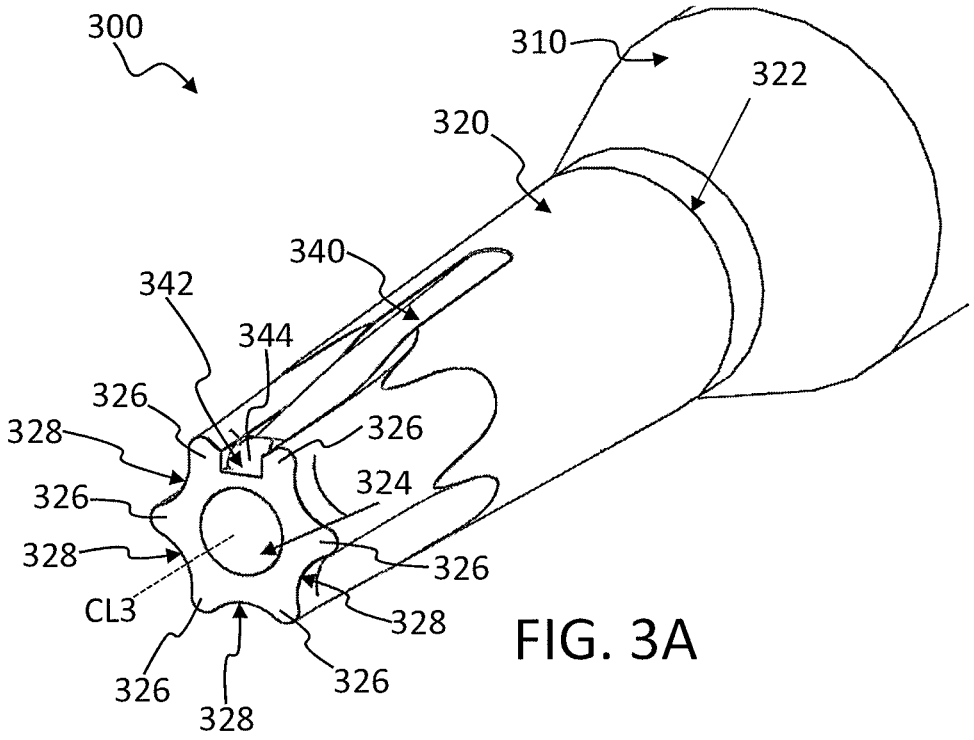
FIG. 3A shows a perspective view of another embodiment of a screwdriver tip.
Figure 3B:
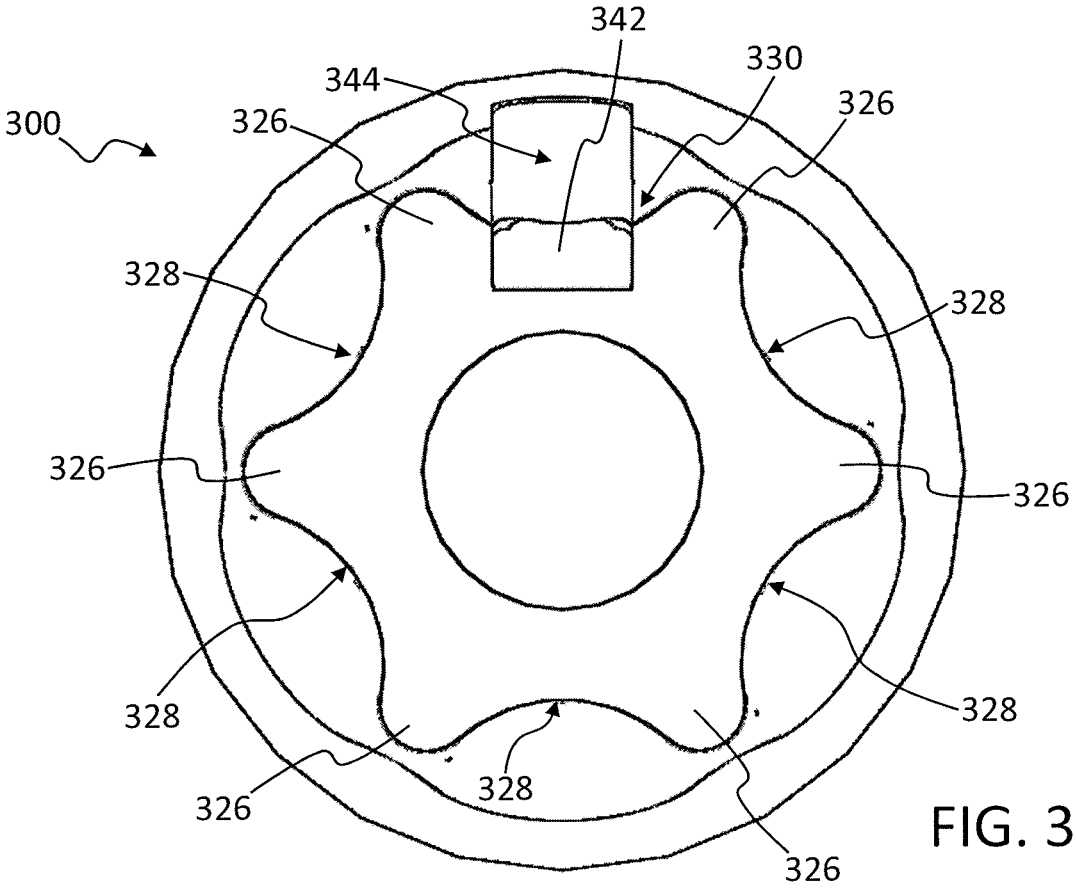
FIG. 3B shows a front view of the screwdriver tip.

Referring to FIGS. 3A-3B, a screwdriver 300 having a screw retention mechanism is provided according to another embodiment of the invention. The screwdriver 300 includes a shaft 310, a tip 320, and an elastic member 340. The tip 320 is radially aligned with a central axis CL3 of the shaft 310. A first end 322 of the tip 320 is attached to the shaft 310 and a second end 324 is opposite the first end 322. The shaft 310 and the tip 320 may be integral (e.g., formed from a single piece), permanenty attached (e.g., formed from separate pieces but attached in a way that does not allow separation), or removably attached (for example, to allow multiple tips to be attached to a single shaft).

The tip 320 is shaped to fit a slot or recess in a corresponding screw. For example, the tip 320 may be shaped to fit a corresponding screw having any standard recess shape, including, but not limited to, flat, cross, phillips, pentalobular, hexalobular, etc. The tip 320 includes at least one regular protrusion 326 which extends away from the central axis CL3. In the embodiment depicted in FIGS. 3A and 3B, the tip 320 includes six regular protrusions 326 in a hexalobular shape. The protrusions 326 are separated by valleys which are radially shorter than the adjacent protrusions. The tip 320 includes at least one notched valley 330 and may further include one or more regular valleys 328. The notched valley 330 is radially shorter than the regular valleys 328 when measured from the central axis CL3 at the notch. For example, as depicted in FIGS. 3A and 3B, the tip 320 includes one notched valley 330 and five regular valleys 328. Typically (but not necessarily), the protrusions 326 and valleys 328, 330 are arranged in a regular pattern around the central axis CL3. Although the tip 320 depicted in FIGS. 3A and 3B has a concave shape, the tip 320 may also be convex. For example, the tip 320 may have a cross section in the shape of a regular polygon, such as a hexagon. In such an embodiment, the regular protrusions 326 are defined by the vertices of the polygon, and the valleys 328, 330 are defined by the sides of the polygon. One of the sides of the polygon is notched and therefore defines the notched valley 330.

The screw retention mechanism of the screwdriver 300 includes an elastic member 340 which is aligned with the notched valley 330. The elastic member 340 may be made of any suitable flexible, elastic material, for example metal or rubber. In the embodiment depicted in FIGS. 3A and 3B, the elastic member 340 is attached to the tip 320 near the first end 322 and includes an unattached end 342 which is separated from the second end 324 of the tip 320 in an unstressed position. In other embodiments, the elastic member 340 may be attached to the shaft 310. The elastic member 340 made be a separate element which is attached to the tip 320 or the shaft 310, or it may be integral with the shaft 310 or the tip 320. The unattached end 342 includes a raised section 344. In the embodiment depicted in FIGS. 3A and 3B, the raised section 344 may be a protrusion extending away from the central axis CL3. In an unstressed position, the raised section 344 has a height (e.g., the distance from the central axis CL3) which is greater than the height of the regular valleys 328. The height of the elastic member 340 at the unattached end 342, however, is less than the height of the regular valleys 328 in the unstressed position, allowing the unattached end 342 to be inserted along with the tip 320 into a corresponding screw.

When the tip 320 is inserted into the recess of a corresponding screw, the unattached end 342 will flex, for example, bend down, toward the central axis CL3 to fit inside the recess, causing the raised section 344 to press against the inside of the recess, creating a tension fit which holds the screw to the tip 320 of the screwdriver 300. The raised section 344 and the notch valley 330 are sized so that the combined height of the raised section 344 and the notched valley 330 (the distance from the central axis CL3) is approximately the same or less than the heights of the regular valleys 328 so that the tip 320 and the elastic member 340 are able to fit in the corresponding screw. To further facilitate attaching the screw to the tip 320, the tip 320 may extend beyond the unattached end 342 of the elastic member 340. This gap between the second end 324 of the tip 320 and the unattached end 342 of the elastic member 340 allows the protrusions 326 to enter the screw recess first and ensure proper alignment between the tip 320 and the screw. Otherwise, were the tip 320 and the screw recess misaligned, the flexible member 340 may not enter the recess and instead be splayed out (e.g., forced away from, rather than toward, the central axis CL3).

Once the screw is secured in the appropriate location, the screwdriver 300 may be easily disengaged from the screw by simply pulling away from the screw parallel to the central axis CL3. Although the elastic member 340 generates sufficient tension to prevent premature disengagement of the screw from the screwdriver 300, it does not hold the screw so tightly to the tip 320 that normal operation of the screwdriver (e.g., inserting the tip 320 into the screw, turning the screw in the substrate, and removing the tip 320 from the screw) is interfered with.

Figure 4A:
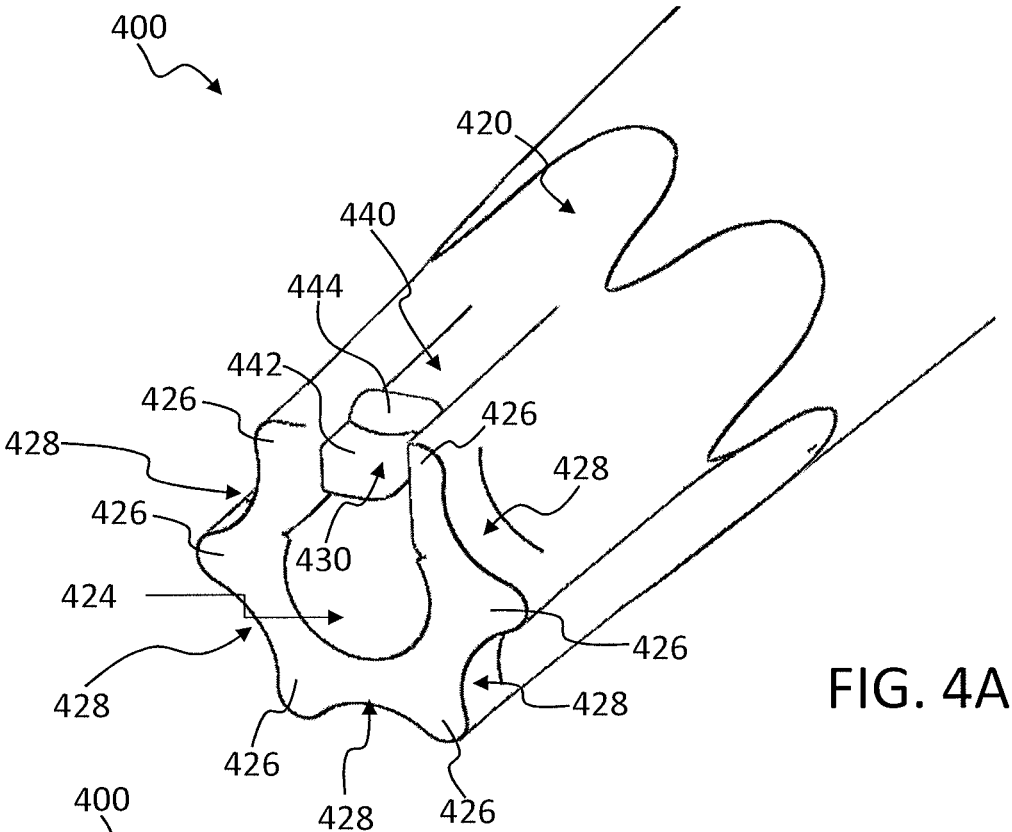
FIG. 4A shows a perspective view of another screwdriver tip.
Figure 4B:
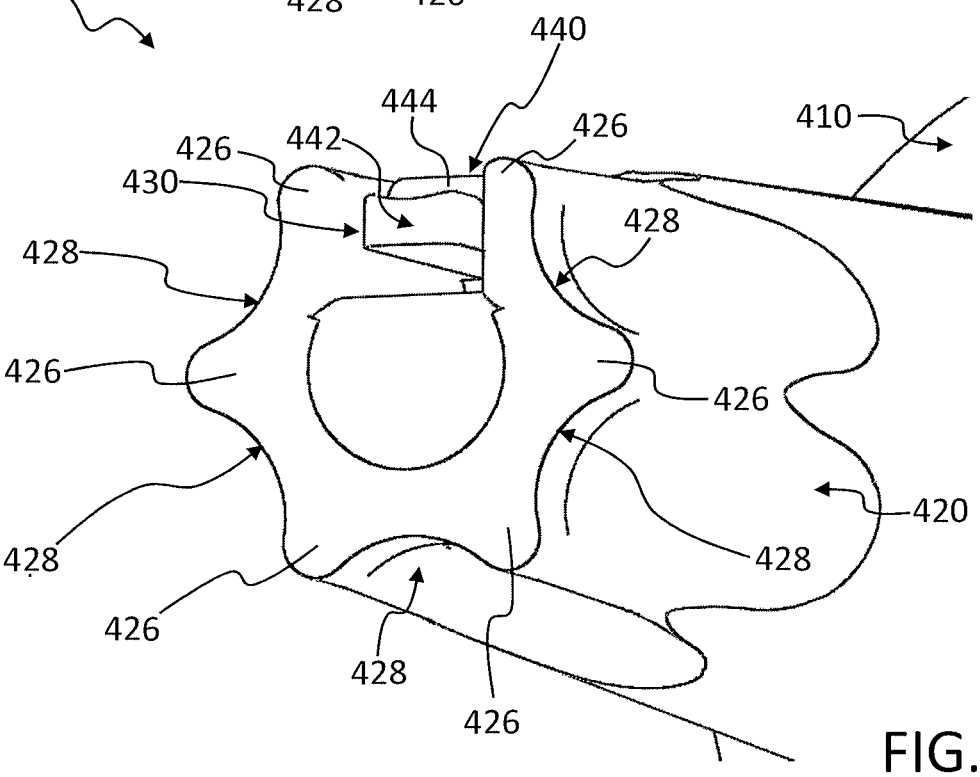
FIG. 4B shows a front view of the screwdriver tip.

Referring to FIGS. 4A-4B, a screwdriver 400 having a screw retention mechanism is provided according to another embodiment of the invention. The screwdriver 400 includes a shaft 410, a tip 420, and an elastic member 440. The shaft 410, the tip 420, and the elastic member 440 are made from a single piece of material. Any suitable material may be used, for example metal, plastic, or rubber, as long as the material provides for sufficient rigidity in the shaft 410 and the tip 420, but also sufficient flexibility in the elastic member 440. A rigid shaft 410 but flexible elastic member 440 may be achieved by making the flexible elastic member 440 substantially thinner than the shaft 410. Because the design is made from a single piece of material, it may be additively manufactured (e.g., 3D printed) to reduce manufacturing costs. The shaft 410 and the tip 420 share a common central axis CL4.

The tip 420 is shaped to fit a slot or recess on a corresponding screw. For example, the tip 420 may be shaped to fit a corresponding screw having any standard recess shape, including, but not limited to, flat, cross, phillips, pentalobular, hexalobular, etc. The tip 420 includes at least one regular protrusion 426 which extends away from the central axis CL4. In the embodiment depicted in FIGS. 4A and 4B, the tip 420 includes six regular protrusions 426 in a hexalobular shape. The protrusions 426 are separated by valleys which are radially shorter than the adjacent protrusions. The tip 420 includes at least one notched valley 430 and may further include one or more regular valleys 428. The notched valley 430 is radially shorter than the regular valleys 428 when measured from the central axis CL4 at the notch. For example, as depicted in FIGS. 4A and 4B, the tip 420 include one notched valley 430 and five regular valleys 428. Typically (but not necessarily), the protrusions 426 and valleys 428, 430 are arranged in a regular pattern around the central axis CL4. Although the tip 420 depicted in FIGS. 4A and 4B has a concave shape, the tip 420 may also be convex. For example, the tip 420 may have a cross section in the shape of a regular polygon, such as a hexagon. In such an embodiment, the regular protrusions 426 are defined by the vertices of the polygon, and the valleys 428, 430 are defined by the sides of the polygon. One of the sides of the polygon is notched and therefore defines the notched valley 430.

The screw retention mechanism of the screwdriver 400 includes the elastic member 440 which is aligned with the notched valley 430. The elastic member 440 has an unattached end 442 which is separate from an end 424 of the tip 420 in an unstressed position. The unattached end 442 includes a raised section 444. In the embodiments pictured in FIGS. 4A and 4B, the raised section 444 is a protrusion extending away from the central axis CL4. In an unstressed position, the raised section 444 has a height (the distance from the central axis CL4) which is greater than the height of the regular valleys 428. The height of the elastic member 440 at the unattached end 442, however, is less than the height of the regular valleys 428 in the unstressed position, allowing the unattached end 442 to be inserted along with the tip 420 into a corresponding screw.

When the tip 420 is inserted into the recess of the corresponding screw, the unattached end 442 will flex, for example, bend down, toward the central axis CL4 to fit inside the recess, causing the raised section 444 to press against the inside of the recess, creating a tension fit which holds the screw to the tip 420 of the screwdriver 400. The raised section 444 and the notched valley 430 are sized so that the combined height of the raised section 444 and the notched valley 430 (the distance from the central axis CL4) is approximately the same as or less than the height of the regular valleys 428 so that the tip 420 and elastic member 440 are able to fit in the corresponding screw.

Once the screw is secured in the appropriate location, the screwdriver 400 may be disengaged from the screw by simply pulling away from the screw parallel to the central axis CL4. Although the elastic member 440 generates sufficient tension to prevent premature disengagement of the screw from the screwdriver 400, it does not hold the screw so tightly to the tip 420 that normal operation of the screwdriver (e.g., inserting the tip 420 into the screw, turning the screw in the substrate, and removing the tip 420 from the screw) is interfered with.

As mentioned above, the tip of the screwdriver is shaped to fit a slot or recess in a corresponding screw. For example, the tip may be shaped to fit a corresponding screw having any standard recess shape, including, but not limited to, flat, cross, phillips, pentalobular, hexalobular, and the like. FIGS. 5-8 depict four of these suitable shapes, which are illustrative only as other shapes are also possible.

Figure 5:
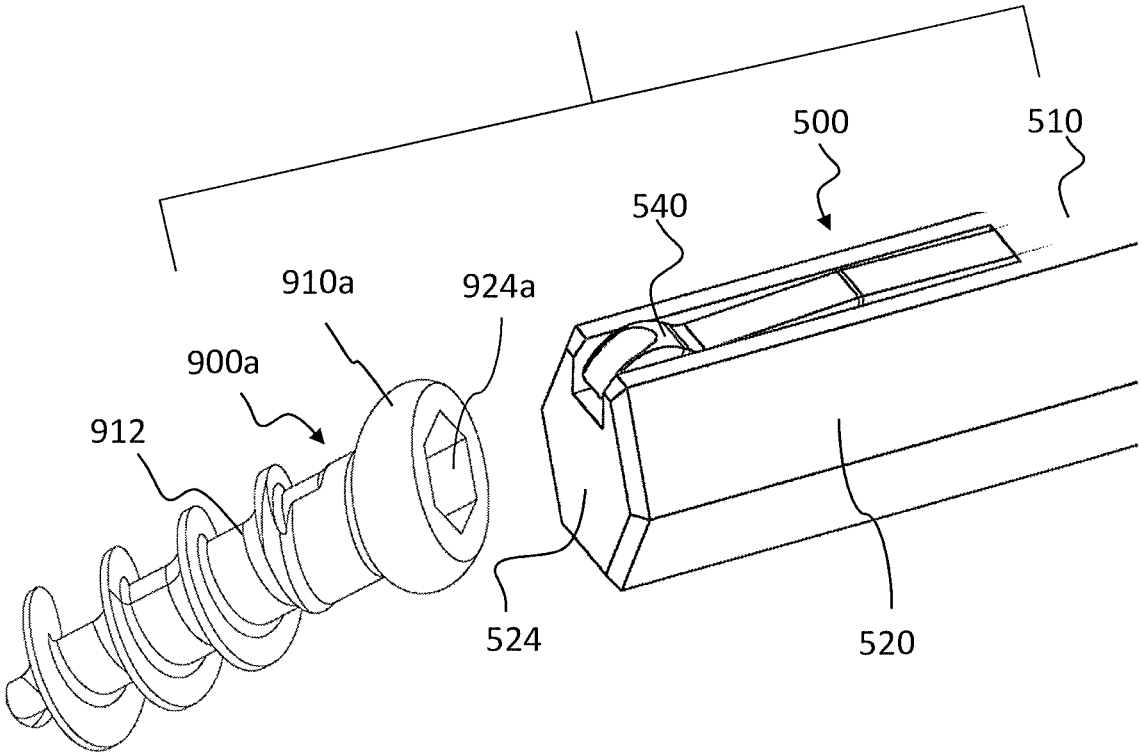
FIG. 5 shows a system including a screwdriver having a hex-shaped end and a screw having a corresponding hex-shaped recess.

Specifically, FIG. 5 shows a system including a screwdriver 500 and a corresponding screw 900*a*. The screwdriver 500 has a shaft 510 and a tip 520. The tip 520 has a hex-shaped end 524 and an elastic member 540. The screw 900*a* has a head 910*a* and a shaft 912. The head 910*a* has a hex-shaped recess 924*a* corresponding with, and adapted to receive or engage with, the end 524.

Figure 6:
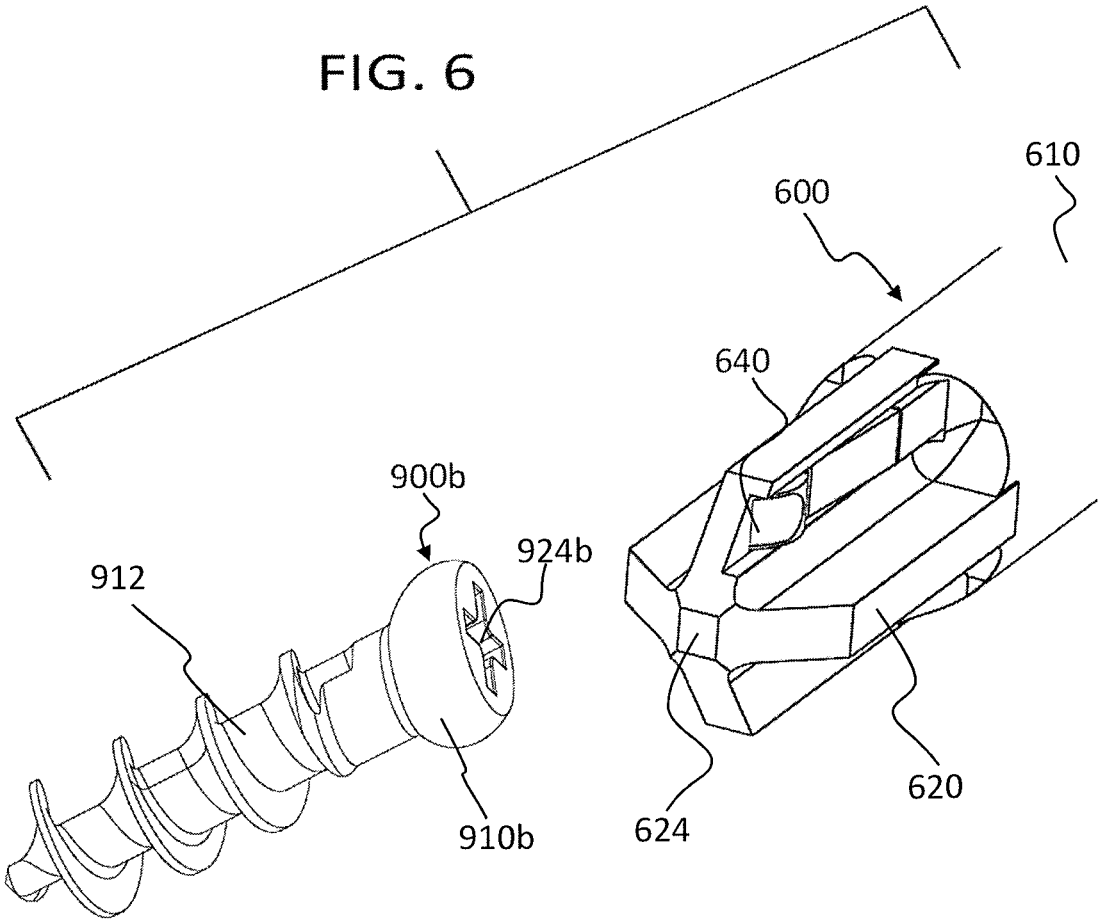
FIG. 6 shows a system including a screwdriver having a phillips-shaped end and a screw having a corresponding phillips-shaped recess.

FIG. 6 shows a system including a screwdriver 600 and a corresponding screw 900*b*. The screwdriver 600 has a shaft 610 and a tip 620. The tip 620 has a phillips-shaped end 624 and an elastic member 640. The screw 900*b* has a head 910*b* and a shaft 912. The head 910*b* has a phillips-shaped recess 924*b* corresponding with, and adapted to receive or engage with, the end 624.

Figure 7:
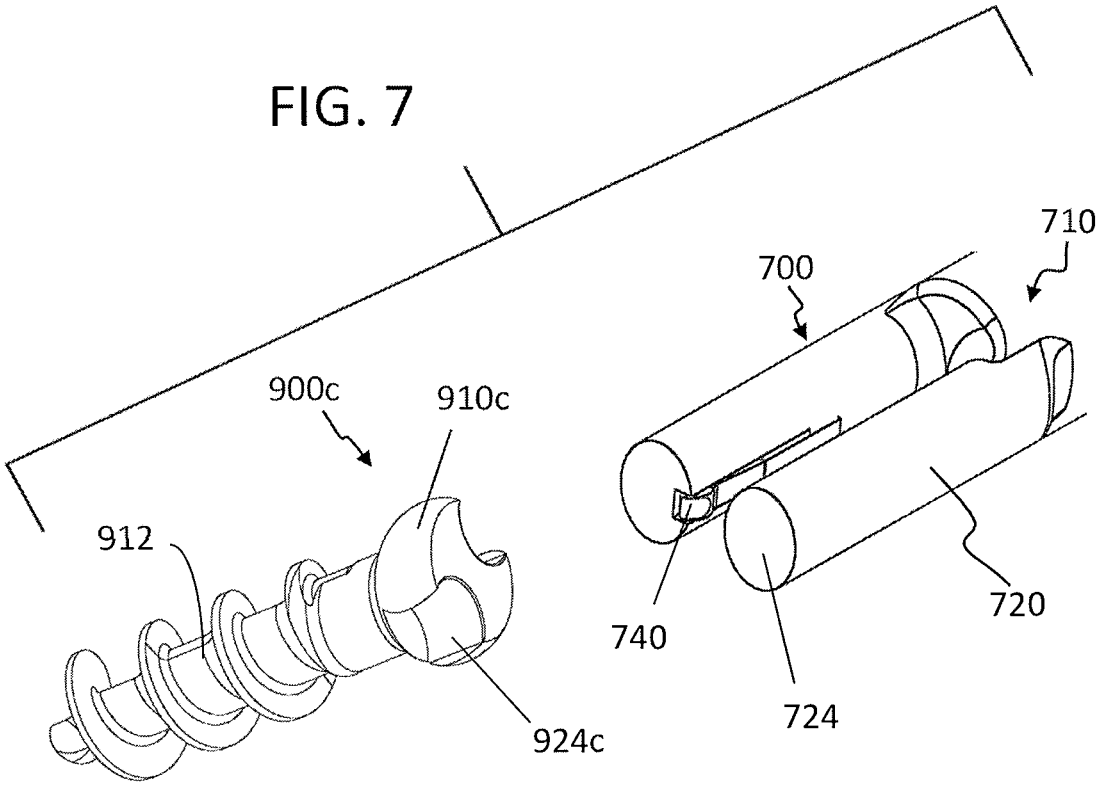
FIG. 7 shows a system including a screwdriver having a spanner-shaped end and a screw having a corresponding spanner-shaped recess.

FIG. 7 shows a system including a screwdriver 700 and a corresponding screw 900*c*. The screwdriver 700 has a shaft 710 and a tip 720. The tip 720 has a spanner-shaped end 724 and an elastic member 740. The screw 900*c* has a head 910*c* and a shaft 912. The head 910*c* has a spanner-shaped recess 924*c* corresponding with, and adapted to receive or engage with, the end 724.

Figure 8:
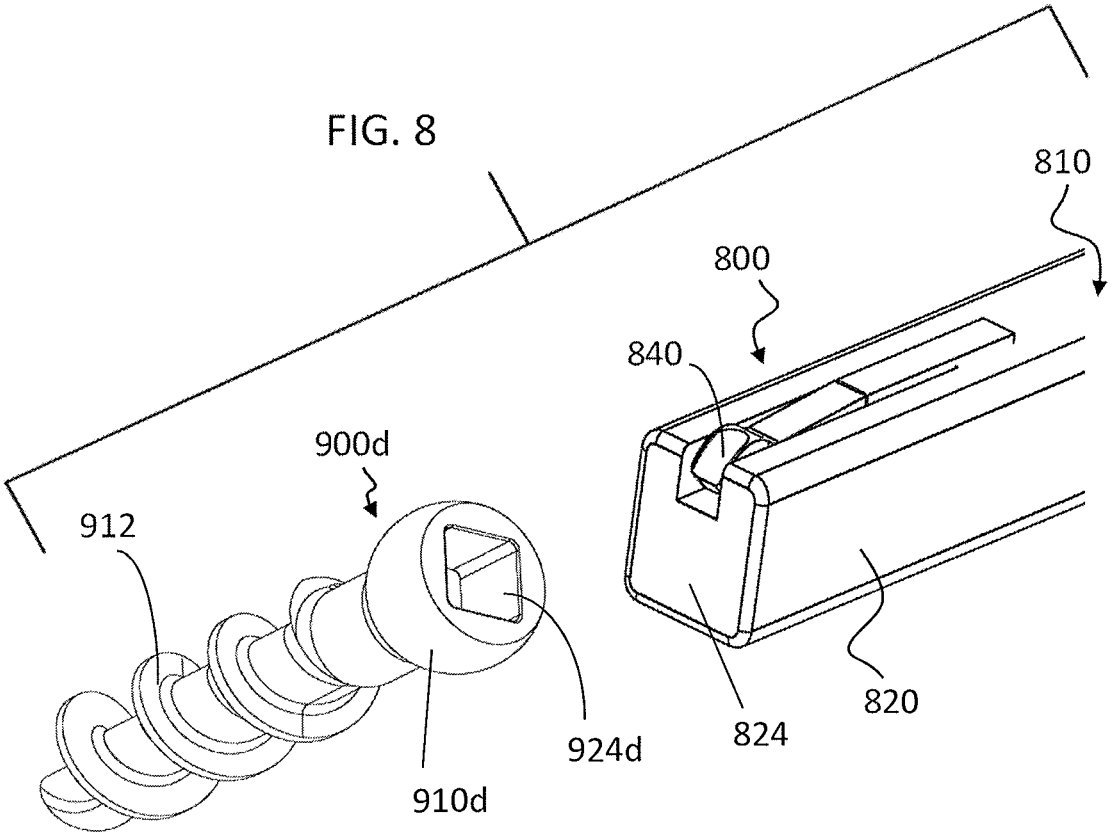
FIG. 8 shows a system including a screwdriver having a square-shaped end and a screw having a corresponding square-shaped recess.

FIG. 8 shows a system including a screwdriver 800 and a corresponding screw 900*d*. The screwdriver 800 has a shaft 810 and a tip 820. The tip 820 has a square-shaped end 824 and an elastic member 840. The screw 900*d* has a head 910*d* and a shaft 912. The head 910*d* has a square-shaped recess 924*d* corresponding with, and adapted to receive or engage with, the end 824.

The screwdrivers 100, 200, 300, 400, 500, 600, 700, 800 may also include a handle (not shown) which is fixably or removably attached to or integral with the shaft 110, 210, 310, 410, 510, 610, 710, 810 of the respective screwdriver on the opposite end of the shaft from the tip. The handle may permit the user to better grip and rotate the shaft in order to turn the screw. A detatchable handle may allow for different sized grips to be attached to the shaft to accommodate different sized hands. The handle may also be integral with the shaft.

The invention is not limited to the embodiments described and exemplified above, but is capable of variation and modification within the scope of the appended claims.

We claim:

1. A screwdriver having an outermost circumference and being adapted to engage a screw, comprising:

a shaft having a central axis;

a tip radially aligned with the central axis of the shaft, the tip having a first end proximate the shaft, a second end opposite the shaft, at least one radial protrusion extending away from the central axis, an external surface, and a notch on the external surface of the tip; and a screw retention mechanism including a flexible member having a body that is aligned with the notch and that extends along a portion of the central axis with which the tip is radially aligned, the body having a first end attached to either the tip or the shaft, a second end that is opposite to the first end of the body, the second end of the body being unattached from the tip and the shaft, and a raised section disposed between the first end and the second end of the body, wherein a leading edge of the second end of the body comprises a top side having a radial height that is less than a radial height of the at least one protrusion in an unstressed position, and wherein when the tip is inserted into a recess of the screw, the flexible member flexes into the notch and toward the central axis and creates an opposing force along substantially its entire length which holds the screw to the tip.

2. The screwdriver of claim 1, wherein the shaft is integral with the tip.

3. The screwdriver of claim 1, wherein the tip is detachable from the shaft.

4. The screwdriver of claim 1, wherein the at least one radial protrusion includes six lobe-shaped protrusions.

5. The screwdriver of claim 1, wherein the flexible member is a separate element from the tip and the shaft.

6. The screwdriver of claim 1, wherein the notch is in the radial protrusion of the at least one radial protrusion.

7. The screwdriver of claim 1, wherein the tip further includes a valley adjacent to the at least one radial protrusion, wherein the valley is defined by a radial height less than the radial height of the at least one radial protrusion, and the notch is in the valley.

8. The screwdriver of claim 1, wherein the flexible member is integral with the tip and the shaft.

9. The screwdriver of claim 8, wherein the notch is in the radial protrusion.

10. The screwdriver of claim 8, wherein the tip further includes a valley adjacent to the at least one radial protrusion, wherein the valley is defined by a radial height less than the radial height of the at least one radial protrusion, and the notch is in the valley.

11. A screwdriver having an outermost circumference and being adapted to engage a screw comprising:

a shaft having a central axis;

a tip radially aligned with the central axis of the shaft, the tip having an end opposite the shaft, at least one regular protrusion, an external surface, and at least one notched protrusion, wherein the notched protrusion is on the external surface of the tip; and a flexible member having a body that is aligned with the notch and extends along a portion of the central axis with which the tip is radially aligned, the body having a first end attached to either the tip or the shaft, a second end that is opposite to the first end of the body, the second end being unattached from the tip and the shaft, and a raised section disposed between the first end and the second end of the body, wherein a leading edge of the second end of the body comprises a top side that faces away from the tip, wherein when the flexible member is in an unstressed position, a radial height of the top side of the leading edge is less than a radial height of the at least one regular protrusion and a radial height of a top side of the raised section is greater than the radial height of the at least one regular protrusion, and wherein when the tip is inserted into a recess of the screw, the flexible member flexes into the notched protrusion and toward the central axis and creates an opposing elastic force along substantially its entire length which holds the screw to the tip.

12. The screwdriver of claim 11, wherein the shaft is integral with the tip.

13. The screwdriver of claim 11, wherein the tip is detachable from the shaft.

14. The screwdriver of claim 11 comprising five lobe-shaped regular protrusions and one notched protrusion.

15. The screwdriver of claim 11, wherein the flexible member is a separate element from the tip and the shaft.

16. The screwdriver of claim 11, wherein the flexible member is integral with the tip and the shaft.

17. A screwdriver having an outermost circumference and being adapted to engage a screw comprising:

a shaft having a central axis;

a tip radially aligned with the central axis of the shaft, the tip having an end opposite the shaft, at least one radial protrusion, an external surface, a regular valley on a first side of the at least one radial protrusion, and a notched valley on a second side of the at least one radial protrusion opposite the first side, wherein the notched valley is on the external surface of the tip; and a flexible member having a body that is aligned with the notched valley and extends along a portion of the central axis with which the tip is radially aligned, the body having a first end attached to either the tip or the shaft, a second end that is opposite to the first end of the body, the second end being unattached from the tip and the shaft, and a raised section disposed between the first end and the second end of the body, wherein a leading edge of the second end of the body comprises a top side that faces away from the tip, wherein when the flexible member is in an unstressed position, a radial height of the top side of the leading edge is less than a radial height of the regular valley and a radial height of a top side of the raised section is greater than the radial height of the regular valley, and wherein when the tip is inserted into a recess of the screw, the flexible member flexes into the notched valley and toward the central axis and creates an opposing elastic force along substantially its entire length which holds the screw to the tip.

18. The screwdriver of claim 17, wherein the at least one radial protrusion includes six lobe-shaped protrusions.

19. The screwdriver of claim 17, wherein the shaft is integral with the tip.

20. The screwdriver of claim 17, wherein the flexible member is a separate element from the tip and the shaft.

* * * * *